US012571601B2

(12) United States Patent
Dubois

(10) Patent No.: US 12,571,601 B2
(45) Date of Patent: Mar. 10, 2026

(54) CHARGING SLIDE FOR FOLDABLE FIREARM

(71) Applicant: Smith & Wesson Inc., Maryville, TN (US)

(72) Inventor: Jason Dubois, North Smithfield, RI (US)

(73) Assignee: SMITH & WESSON INC., Maryville, TN (US)

( * ) Notice: Subject to any disclaimer, the term of this patent is extended or adjusted under 35 U.S.C. 154(b) by 133 days.

(21) Appl. No.: 18/405,415

(22) Filed: Jan. 5, 2024

(65) Prior Publication Data

US 2024/0240892 A1 Jul. 18, 2024

Related U.S. Application Data

(60) Provisional application No. 63/479,906, filed on Jan. 13, 2023.

(51) Int. Cl.

| | |
|---|---|
| ***F41A 11/04*** | (2006.01) |
| ***F41A 3/66*** | (2006.01) |
| ***F41A 3/72*** | (2006.01) |
| *F41A 35/06* | (2006.01) |

(52) U.S. Cl.

CPC ..... *F41A 11/04* (2013.01); *F41A 3/66* (2013.01); *F41A 3/72* (2013.01); *F41A 35/06* (2013.01)

(58) Field of Classification Search

CPC ..... F41C 23/04; F41C 23/16; F41C 23/14; F41A 11/04; F41A 3/72; F41A 3/66; F41A 3/84; F41A 11/02; F41A 35/06

USPC ..... 89/1.4; 42/73, 2, 18, 50, 6, 71.01, 75.03

See application file for complete search history.

(56) References Cited

U.S. PATENT DOCUMENTS

| | | | |
|---|---|---|---|
| 8,429,844 | B2 | 4/2013 | Dextraze et al. |
| 8,522,465 | B2 | 9/2013 | Jarboe et al. |
| 8,769,855 | B2 | 7/2014 | Law |
| 8,915,005 | B2 | 12/2014 | Grimshaw et al. |
| 9,239,203 | B2 | 1/2016 | Jarboe et al. |
| 9,347,738 | B1 | 5/2016 | Schumacher |
| 9,546,845 | B2 | 1/2017 | Mather |
| 9,719,754 | B2 | 8/2017 | Law |
| 9,995,556 | B2 | 6/2018 | Hall |
| 10,113,832 | B2 | 10/2018 | Law |
| 10,156,421 | B2 | 12/2018 | Smith et al. |
| 10,605,563 | B2 | 3/2020 | Hall |
| 10,704,848 | B1 | 7/2020 | Zeider et al. |
| 10,704,860 | B2 | 7/2020 | Hall |
| 11,118,860 | B2 | 9/2021 | Zimmer |
| 11,143,470 | B1 | 10/2021 | Roth |
| 11,441,869 | B2 | 9/2022 | Zimmer |

(Continued)

*Primary Examiner* — Michael D David

(74) *Attorney, Agent, or Firm* — Ballard Spahr LLP

(57) ABSTRACT

A charging slide for carrying a bolt and latching a firearm in a folded position. The charging slide comprises a body, a projection, and a grip. The projection extends away from a first surface of the body along a first axis. The projection is configured to engage the bolt. The grip extends away from a first side of the body along a second axis oriented transversely to the first axis. The grip comprises a surface configured to engage an edge of a slot in a handguard of the firearm when the firearm is in the folded position. A receiver assembly and foldable firearm comprising the charging slide are also included.

20 Claims, 8 Drawing Sheets

(56) References Cited

U.S. PATENT DOCUMENTS

| | | | | |
|---|---|---|---|---|
| 2010/0162604 | A1* | 7/2010 | Dubois | F41A 21/482 42/2 |
| 2010/0307042 | A1 | 12/2010 | Jarboe et al. | |
| 2014/0196345 | A1 | 7/2014 | Grimshaw et al. | |
| 2019/0339038 | A1 | 11/2019 | Law et al. | |
| 2022/0082342 | A1 | 3/2022 | Roth | |
| 2024/0167778 | A1* | 5/2024 | Dubois | F41A 3/84 |
| 2024/0263901 | A1* | 8/2024 | Dubois | F41A 17/36 |

* cited by examiner

CHARGING SLIDE FOR FOLDABLE FIREARM

CROSS-REFERENCE TO RELATED APPLICATION

This application claims the benefit of the filing date of U.S. Provisional Patent Application No. 63/479,906, filed Jan. 13, 2023, the entirety of which is hereby incorporated by reference herein.

FIELD

This disclosure relates to charging slides for carrying bolts of firearms, in particular, charging slides of foldable firearms.

BACKGROUND

A long gun (e.g., rifle) which folds decreases the overall length of the long gun making it compact and easier and more efficient to store and carry. A mechanism which locks a long gun in a folded position to prevent the long gun from unwantedly pivoting between a folded position and a firing position when being carried or stowed is clearly beneficial.

A charging slide (or charging handle) is often central to the operation of a rifle or other long gun, as its action draws the bolt out of battery. This action allows the shooter to open the breech and eject spent cartridges from the chamber and load a new round from the magazine. Opening the breech also allows the shooter to verify the chamber is clear of rounds or obstructions and/or clear any stoppages before moving the bolt back into battery. A charging slide can be essential to the rifle and other long guns.

SUMMARY

An example charging slide for carrying a bolt and latching a firearm in a folded position according to the disclosure comprises a body, a projection, and a grip. The projection extends away from a first surface of the body along a first axis. The projection is configured to engage the bolt. The grip extends away from a first side of the body along a second axis oriented transversely to the first axis. The grip comprises a surface configured to engage an edge of a slot in a handguard of the firearm when the firearm is in the folded position.

In an example embodiment, the charging slide further comprises a second grip extending away from a second side opposing the first side of the body along the second axis.

In an example embodiment, the body includes a first channel and a second channel configured to engage a rail in a receiver of the firearm.

In an example embodiment, the first channel and the second channel are configured to slide along the rail along a longitudinal axis of the firearm.

The disclosure also encompasses a receiver assembly for a foldable firearm. The receiver assembly comprises a housing, a bolt, and a charging slide. The housing comprises a rail and a slot extending along a longitudinal axis. The bolt is disposed within the housing and movable along the longitudinal axis. The charging slide comprises a body, a projection, and a grip. The body comprises a first channel and a second channel coupled to the rail. The first channel and the second channel is slidable on the rail along the longitudinal axis. The projection extends away from a first surface of the body along a first axis. The projection extends through the slot in the housing and engages the bolt. The grip extends away from a first side of the body along a second axis oriented transversely to the first axis. The grip comprises a surface configured to engage an edge of a slot in a handguard of the firearm when the firearm is in a folded position.

In an example embodiment, the receiver assembly further comprises an action spring disposed within the housing and biases the bolt in a first direction along the longitudinal axis.

In an example embodiment, the charging slide moves the bolt in a second direction along the longitudinal axis when the charging slide moves in the second direction along the rail.

In an example embodiment, the bolt compresses the action spring when moving in the second direction.

In an example embodiment, the receiver assembly further comprises a second grip extending away from a second side opposing the first side of the body along the second axis.

The disclosure also encompasses a foldable firearm. The firearm comprises a stock, a barrel, and a receiver assembly. A handguard surrounds the barrel. The handguard comprises at least one slot extending along a longitudinal axis. The receiver assembly is coupled to the stock and pivotably coupled to the barrel. The barrel is pivotable about a third axis oriented transversely to the longitudinal axis between a folded position and a firing position. The receiver assembly comprises a housing, a bolt, and a charging slide. The housing comprises a rail and a slot extending along the longitudinal axis. The bolt is disposed within the housing and movable along the longitudinal axis. The charging slide comprises a body, a projection, and a grip. The body comprises a first channel and a second channel coupled to the rail. The first channel and the second channel slidable on the rail along the longitudinal axis. The projection extends away from a first surface of the body along a first axis oriented transversely to the longitudinal axis. The projection extends through the slot in the housing and engages the bolt. The grip extends away from a first side of the body along a second axis oriented transversely to the first axis. The grip comprises a surface configured to engage an edge of a first slot of the at least one slot in the handguard when the barrel is in the folded position.

In an example embodiment, the foldable firearm further comprises an action spring disposed within the housing and biases the bolt in a first direction along the longitudinal axis.

In an example embodiment, the charging slide moves the bolt in a second direction along the longitudinal axis when the charging slide moves in the second direction along the rail.

In an example embodiment, the bolt compresses the action spring when moving in the second direction.

In an example embodiment, the foldable firearm further comprises a second grip extending away from a second side opposing the first side of the body along the second axis.

In an example embodiment, the barrel is pivotably coupled to the receiver assembly via a hinge.

DETAILED DESCRIPTION

Figure 1:
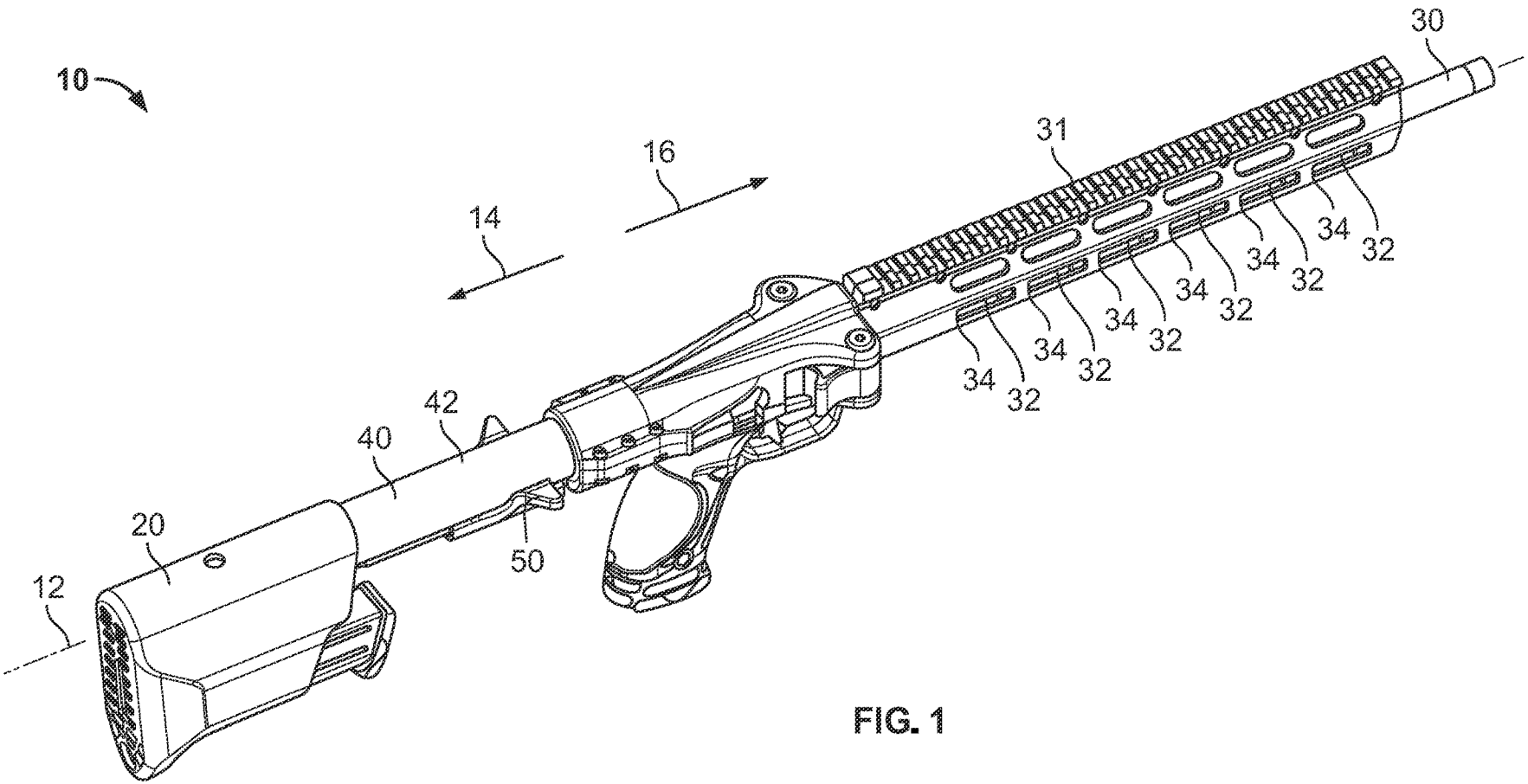
FIG. 1 is a perspective view of an example firearm according to the disclosure showing an example charging slide in a first position.
Figure 2:
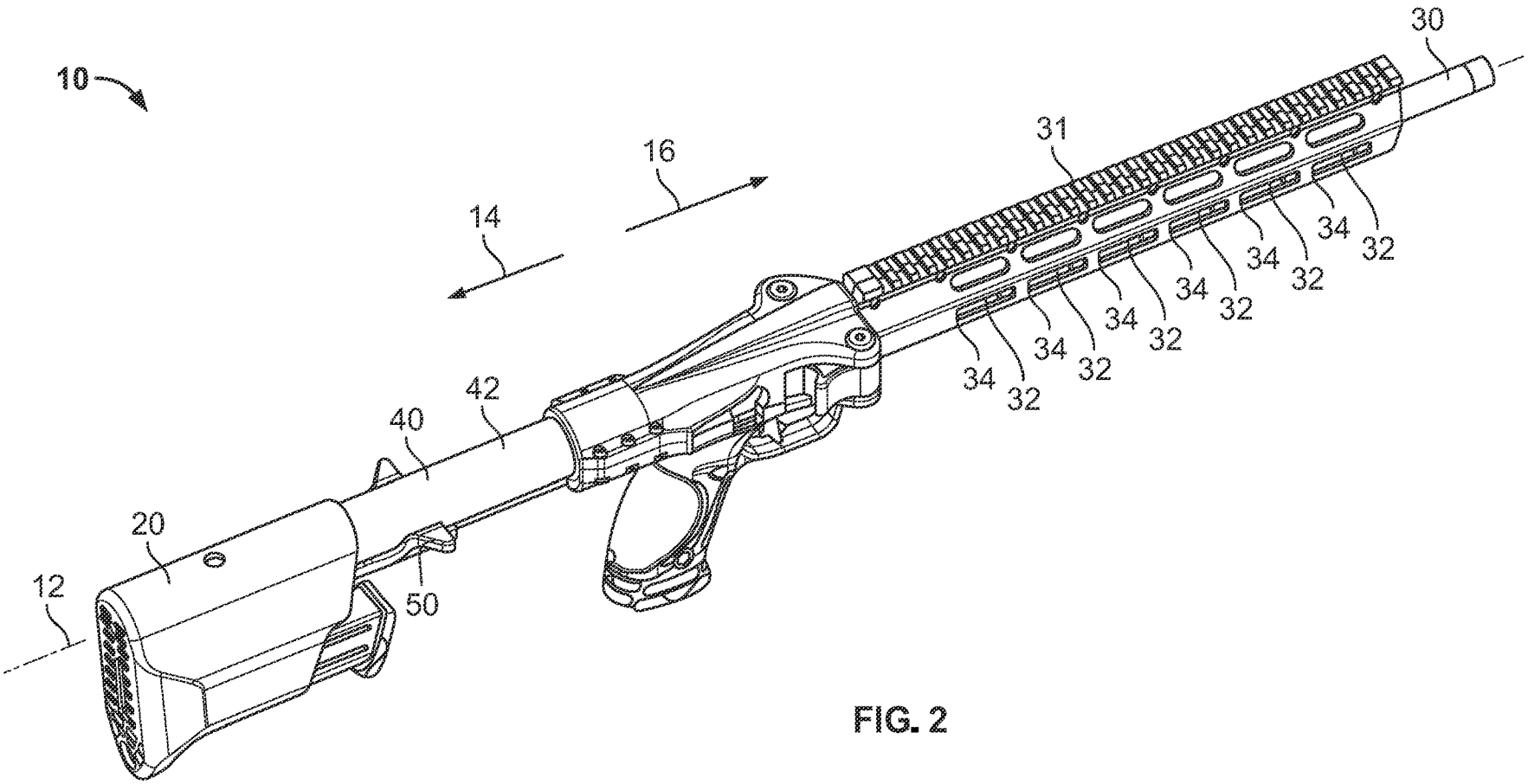
FIG. 2 is a perspective view of the example firearm of FIG. 1 showing the example charging slide in a second position.

FIGS. 1 and 2 show an example foldable firearm 10, in this example a foldable carbine, in a firing or use position. Although depicted in the drawings as a carbine, it is contemplated that other firearm designs and configurations can be compatible with the current disclosure. For example, it is contemplated that the firearm 10 can be a rifle or other long gun. In one aspect, the firearm 10 is not an AR-15 rifle. Further, the firearm 10 may operate via a blowback system. In a further example, the firearm 10 may operate via a blowback system that functions without a barrel extension.

As shown in FIGS. 1 and 2, the firearm 10 includes a stock 20 and a barrel 30 coupled to a receiver assembly 40. A handguard 31 surrounds a least a portion of the barrel 30. In one example, the stock 20 and the barrel 30 are removably coupled to the receiver assembly 40. In one aspect, the barrel 30 may be directly coupled to the receiver assembly 40. In one example, the barrel 30 is not connected to the receiver assembly 40 via a barrel extension. Further, in one aspect, the foldable firearm 10 does not comprise (is free of) a barrel extension. The receiver assembly 40 includes a charging slide 50 (also known as a charging handle). The charging slide 50 is configured to move on a receiver housing 42 in a first (i.e. rearward) direction 14 and a second (i.e. forward) direction 16 along a longitudinal axis 12 between a first position, shown in FIG. 1, and a second position, shown in FIG. 2.

Figure 3:
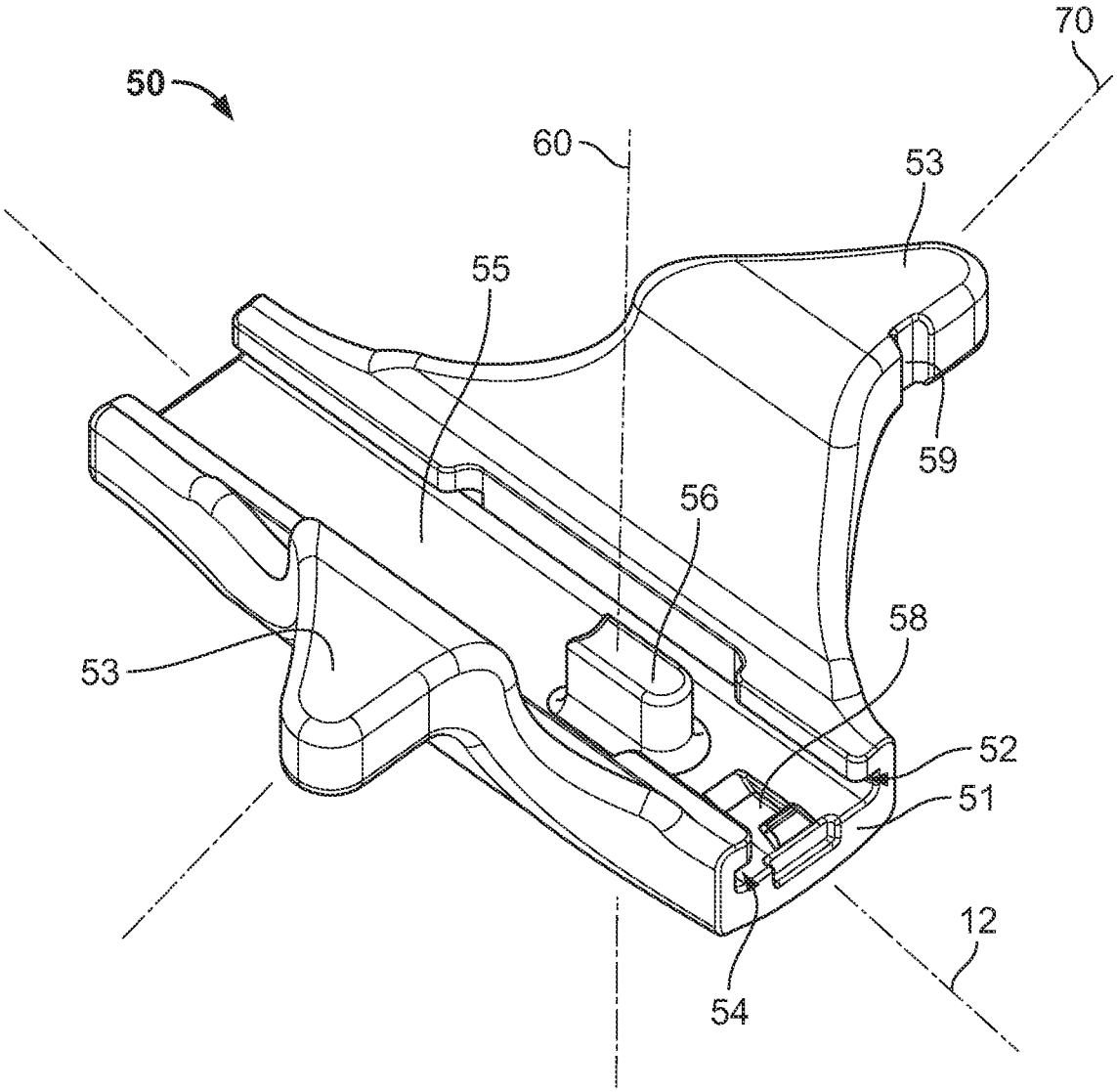
FIG. 3 is a perspective view of an example charging slide.
Figure 4:
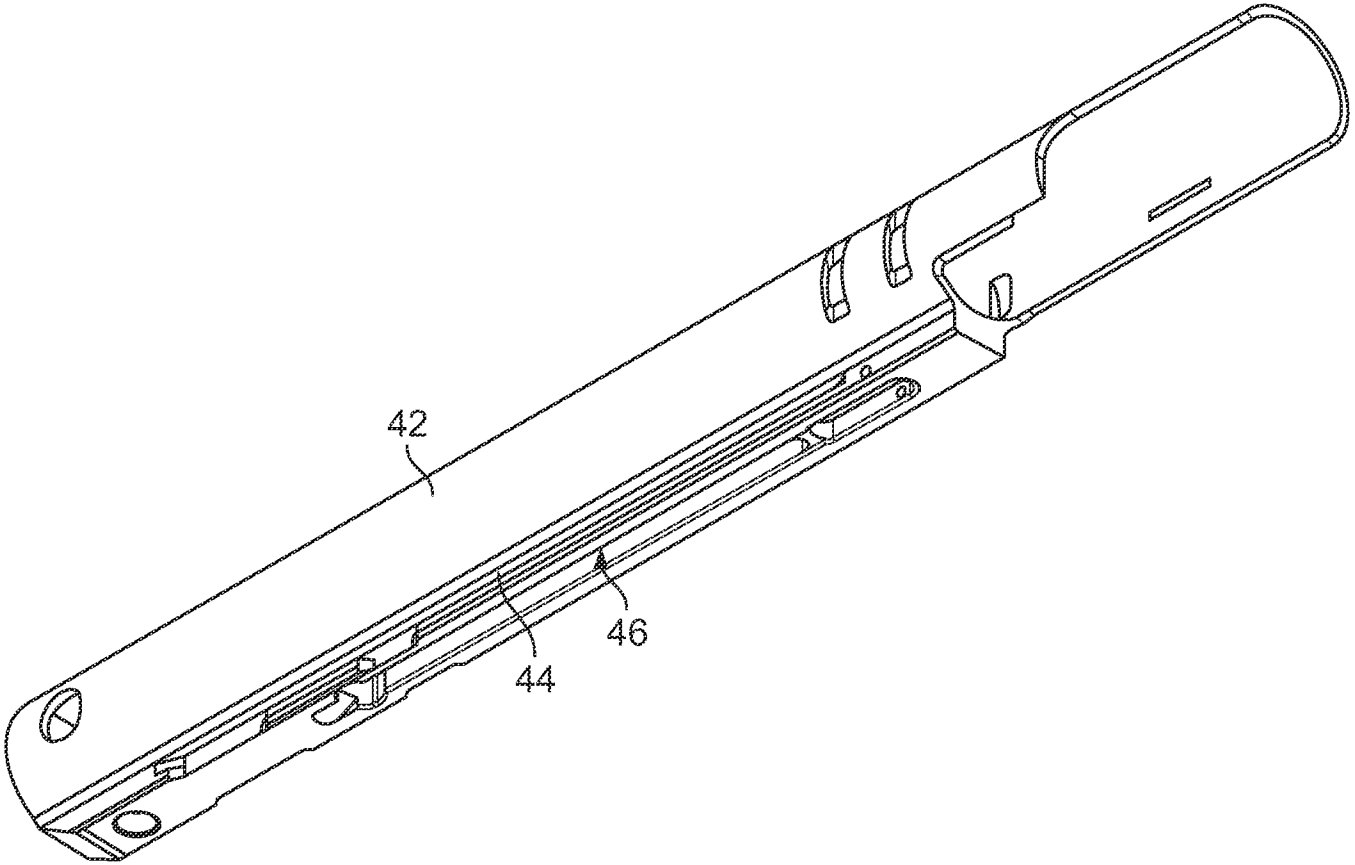
FIG. 4 is a perspective view of an example receiver housing.

With reference to FIG. 3, the charging slide 50 includes a body 51. The body 51 may include a first channel 52 and a second channel 54 configured to slide along a rail 44 coupled to or embedded in the receiver housing 42, shown in FIG. 4, which allows the charging slide 50 to move in the first and second directions 14, 16 along the longitudinal axis 12. As shown in FIG. 3, the charging slide 50 also includes a projection 56 extending away from a base surface 55 of the body 51 along a first axis 60 oriented transversely to the longitudinal axis 12. The projection 56 is configured to be inserted through (received within) a slot 46 extending along the longitudinal axis 12 in the receiver housing 42 shown in FIG. 4.

Figure 5:
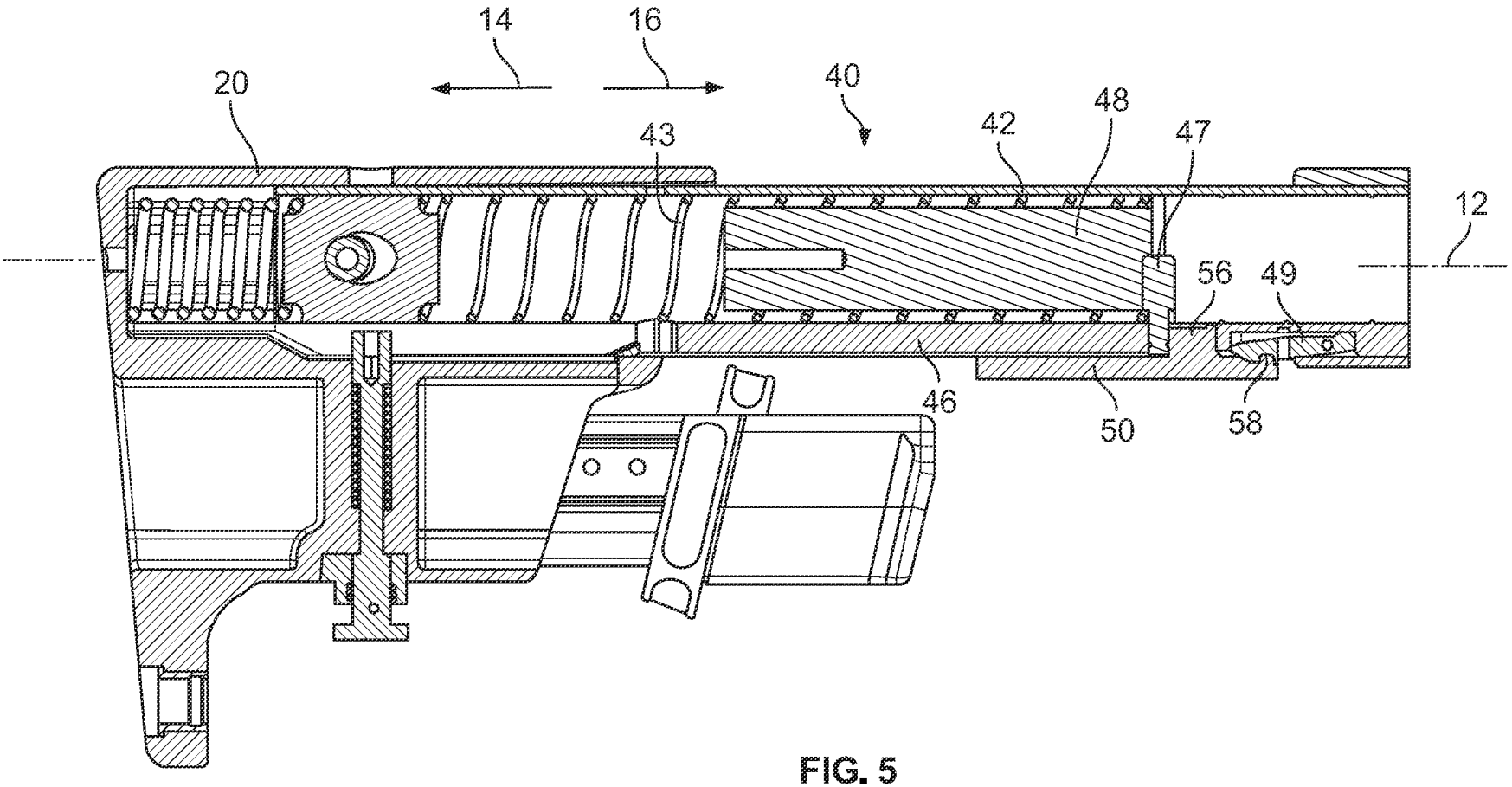
FIG. 5 is a side section view of an example receiver assembly and charging slide.

With reference to FIG. 5, the projection 56 extends through the slot 46 in the receiver housing 42 to engage a bolt 48 disposed within the housing 42. In this example, the projection 56 engages with or is coupled to the bolt 48 via a charging lug 47 projecting from the bolt 48 (optionally, with the charging lug 47 extending parallel to the first axis 60). The bolt 48 is movable in the first and second directions 14, 16 along the longitudinal axis 12 within the receiver housing 42. An action spring 43 biases the bolt 48, and therefore the charging slide 50, in the second direction 16. When the bolt 48 and charging slide 50 are in the first (or forwardmost) position (shown in FIG. 1), the bolt 48 is in battery. The receiver housing 42 may include a detent 49 to catch and hold the charging slide 50 in the first position until a force acting on the charging slide 50 in the first direction 14 overcomes and releases the charging slide 50 from the detent 49. In one example, the charging slide 50 may comprise a spring loaded catch 58, shown in FIG. 3 and FIG. 5, configured to catch and retain the detent 49.

With reference to FIG. 3, the charging slide 50 includes at least one grip 53 extending away from the body 51 along a second axis 70 oriented transversely to the first axis 60 and the longitudinal axis 12. The shooter may grab a grip 53 to move the charging slide 50. In one example, the charging slide 50 may be an ambidextrous charging slide in which a grip 53 extends from both (the left and right) sides of the body 51 to allow a shooter to grasp a grip 53 with either hand. In other examples, the charging slide 50 may include a grip 53 on only one of the left or right sides of the body 51. A shooter may grasp a grip 53 and pull the charging slide 50, and therefore the bolt 48, in the first direction 14 along the longitudinal axis 12 to compress the action spring 43 and pull the bolt 48 out of battery (shown in FIG. 2). This action allows the shooter to open the breech and eject spent rounds. This action also allows the shooter to load a new round from a magazine. When a new magazine is loaded, the grip 53 may be pulled and then subsequently released. After the grip 53 is released, the action spring 43 biases the bolt 48 in the second direction 16 and back into battery, stripping and chambering a new round from a magazine.

Figure 6:
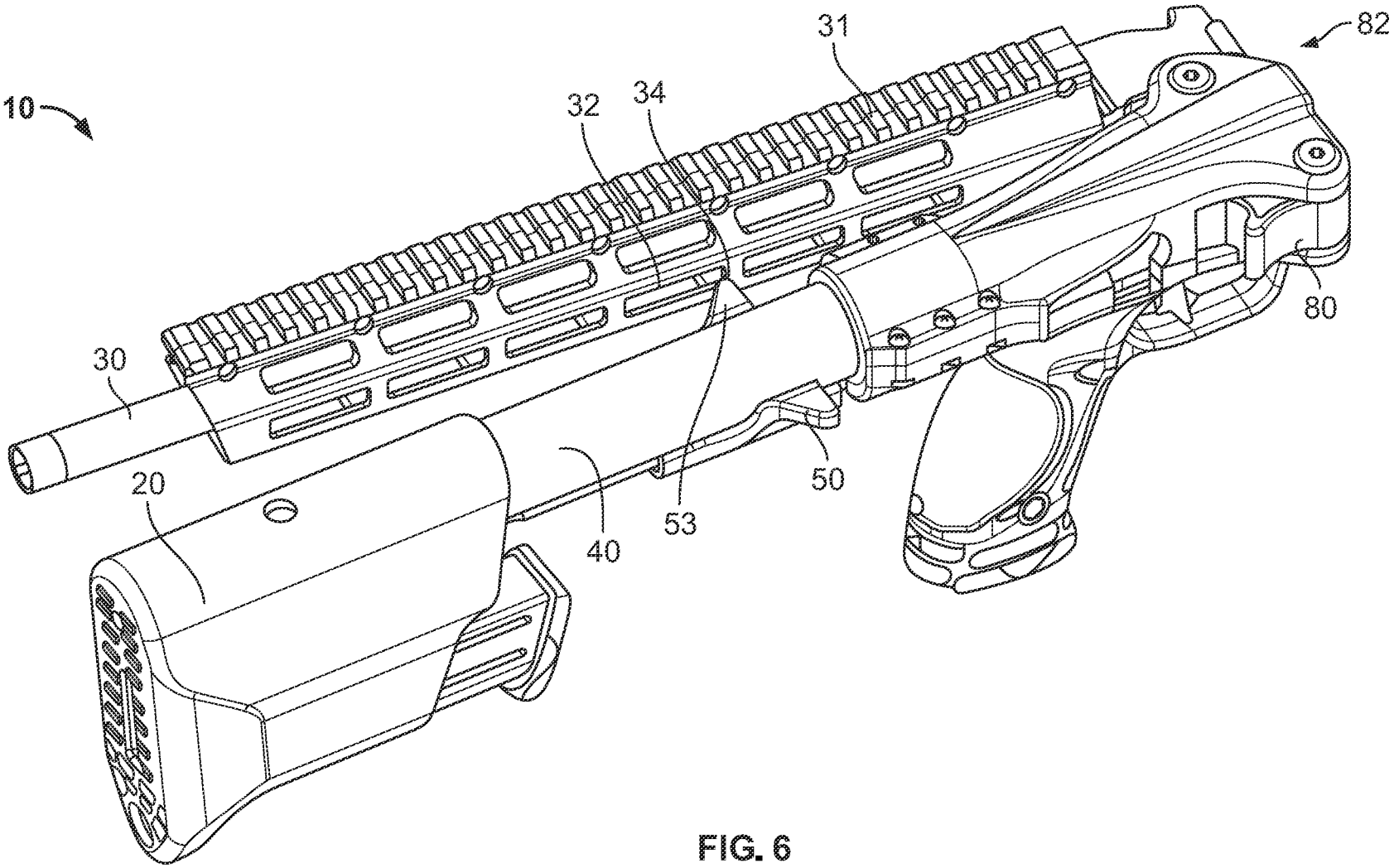
FIG. 6 is a perspective view of the example firearm in FIG. 1 in a position between the folded position and the use or firing position.
Figure 7:
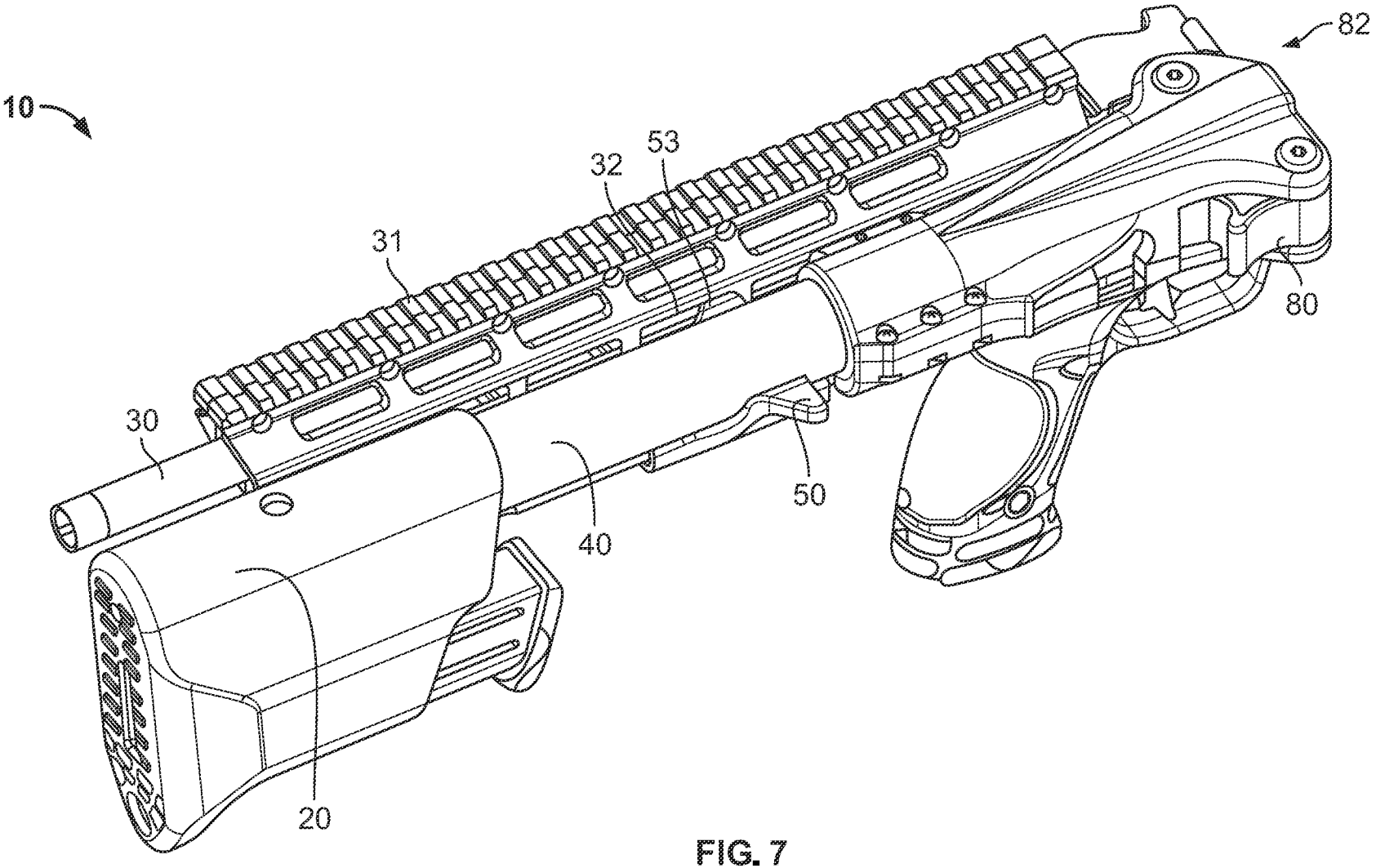
FIG. 7 is a perspective view of the example firearm in FIG. 1 in the folded position.
Figure 8:
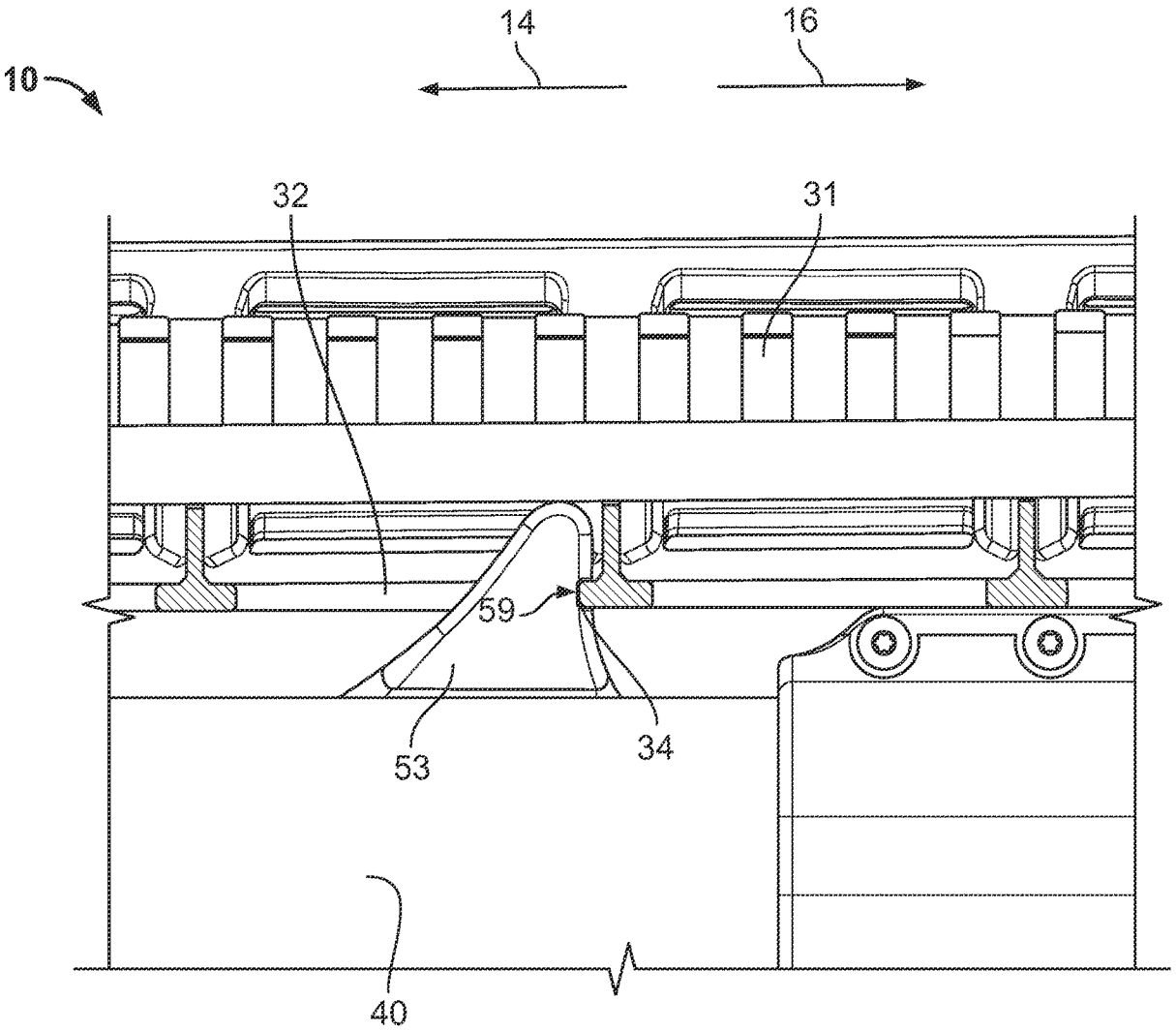
FIG. 8 is a top, partial section view of an example slot in the handguard of the example firearm of FIG. 7 showing an example charging slide locking the example firearm in the folded position.

With reference to FIGS. 6-8, the firearm 10 may be folded and latched in a folded position via the charging slide 50. The firearm 10 may include a latch 80 which locks the firearm 10 in the use or firing position shown in FIGS. 1 and 2. When the latch 80 is released, the barrel 30 is configured to pivot about a hinge mechanism 82. Optionally, the hinge mechanism 82 may comprise a hinge rotating about a pin coupled or connected to the receiver assembly 40. As shown in FIGS. 6 and 7, the barrel 30 is configured to pivot to a side of the firearm 10 to a folded position. In this example, the firearm 10 is configured to pivot to a left side of the receiver assembly 40 and stock 20. However, the firearm 10 can be configured to pivot to a right side, opposite the left side, of the receiver assembly 40 and stock 20. Because the firearm 10 is configured to pivot to a side (and not to the top or bottom), any optics that are coupled or connected to the top surface of the barrel 30 or handguard 31 may remain intact without inhibiting the firearm 10 from folding. Although not shown, the firearm 10 may include a cap or plug configured to insert and/or cover the open breech and/or action to protect the breech and/or action from debris during transportation or while being stored.

With reference to FIG. 8, the charging slide 50 locks the firearm 10 in the folded position. As shown in FIG. 3 and FIG. 8, a grip 53 of the charging slide 50 includes a surface 59 configured to engage an edge 34 of the slot 32 in the handguard 31 when the firearm 10 is in the folded position. In one example, the surface 59 may be (or be defined by) a recess in the grip 53 which receives the edge 34 of the slot 32. The action spring 43 biases the charging slide 50 in the second direction 16 to keep the surface 59 of the grip 53 engaged with the edge 34 of the slot 32. To unfold the firearm 10, the shooter may pull the charging slide 50 in the first direction 14 to retract the charging slide 50 enough to disengage the surface 59 from the edge 34 of the slot 32 and pull the charging slide 50 out from the slot 32. The shooter may then unfold the firearm 10 and lock the barrel 30 with the latch 80 in the firing or use position.

Optionally, it is contemplated that the grip 53 that is configured to engage the edge of the slot 32 can have a first shape that includes surface 59, while the grip on the opposing side of the firearm 10 can have a second shape that is different than the first shape and that does not include a corresponding surface for engaging the edge of the slot 32. Alternatively, it is contemplated that the charging slide 50 can include two grips 53 on opposing sides of the firearm that have corresponding (e.g., mirror image) geometries that include respective surfaces that are configured to engage a slot 32 of the handguard 31 as further disclosed herein, thereby providing a charging slide 50 that is capable of engaging a handguard of a firearm that pivots/folds in either direction.

In use, it is expected that the example charging slide 50 according to the disclosure can allow a shooter to quickly and efficiently lock a foldable firearm 10 in a compact, folded position for transportation or storage. In particular, the disclosed charging slide 50 can serve the dual purposes of drawing the bolt of the firearm out of battery and also engaging the handguard of the firearm 10 to lock the firearm in a folded position.

All of the embodiments of the claimed invention described herein are provided expressly by way of example only. Innumerable variations and modifications may be made to the example embodiments described herein without departing from the concept of this disclosure. Additionally, the scope of this disclosure is intended to encompass any and all modifications and combinations of all elements, features, and aspects described in the specification and claims, and shown in the drawings. Any and all such modifications and combinations are intended to be within the scope of this disclosure.

What is claimed is:

1. A charging slide for carrying a bolt and locking a firearm in a folded position, said charging slide comprising:
- a body;
- a projection extending away from a first surface of said body along a first axis, said projection configured to engage said bolt; and
- a grip extending away from a first side of said body along a second axis oriented transversely to said first axis, said grip configured to engage said handguard of said firearm when said firearm is in said folded position.

2. The charging slide according to claim 1, wherein said grip comprises a surface configured to engage an edge of a slot in said handguard of said firearm when said firearm is in said folded position.

3. The charging slide according to claim 2, wherein said surface of said grip is defined by a recess in said grip.

4. The charging slide according to claim 1, further comprising a second grip extending away from a second side opposing said first side of said body along said second axis.

5. The charging slide according to claim 1, wherein said body includes a first channel and a second channel configured to engage a rail in a receiver of said firearm.

6. The charging slide according to claim 5, wherein said first channel and said second channel are configured to slide along said rail along a longitudinal axis of said firearm.

7. The charging slide according to claim 1, wherein said projection is configured to engage said bolt via a charging lug.

8. A receiver assembly for a foldable firearm, said receiver assembly comprising:
- a housing comprising a rail and a slot extending along a longitudinal axis;
- a bolt disposed within said housing and movable along said longitudinal axis;
- a charging slide comprising:
  - a body comprising a first channel and a second channel coupled to said rail, said first channel and said second channel slidable on said rail along the longitudinal axis;
  - a projection extending away from a first surface of said body along a first axis, said projection extending through said slot in said housing and engaging said bolt; and
  - a grip extending away from a first side of said body along a second axis oriented transversely to said first axis, said grip comprising a surface configured to engage an edge of a slot in a handguard of said firearm when said firearm is in a folded position.

9. The receiver assembly according to claim 8, further comprising an action spring disposed within said housing and biasing said bolt in a first direction along said longitudinal axis.

10. The receiver assembly according to claim 9, wherein said charging slide moves said bolt in a second direction along said longitudinal axis when said charging slide moves in said second direction along said rail.

11. The receiver assembly according to claim 10, wherein said bolt compresses said action spring when moving in said second direction.

12. The receiver assembly according to claim 8, further comprising a second grip extending away from a second side opposing said first side of said body along said second axis.

13. The receiver assembly according to claim 8, wherein said surface of said grip is defined by a recess in said grip.

14. The receiver assembly according to claim 8, wherein said body comprises a spring loaded catch and said housing comprises a detent, said spring loaded catch configured to catch and retain said detent.

15. A foldable firearm comprising:
- a stock;
- a barrel;
- a handguard surrounding said barrel comprising at least one slot extending along a longitudinal axis; and
- a receiver assembly coupled to said stock and pivotably coupled to said barrel, wherein said barrel is pivotable about a third axis oriented transversely to said longitudinal axis between a folded position and a firing position, said receiver assembly comprising:
  - a housing comprising a rail and a slot extending along said longitudinal axis;
  - a bolt disposed within said housing and movable along said longitudinal axis;
  - a charging slide comprising:
    - a body comprising a first channel and a second channel coupled to said rail, said first channel and said second channel slidable on said rail along said longitudinal axis;
    - a projection extending away from a first surface of said body along a first axis oriented transversely to said longitudinal axis, said projection extending through said slot in said housing and engaging said bolt; and
    - a grip extending away from a first side of said body along a second axis oriented transversely to said first axis, said grip comprising a surface configured to engage an edge of a first slot of said at least one slot in said handguard when said barrel is in said folded position.

16. The foldable firearm according to claim 15, further comprising an action spring disposed within said housing and biasing said bolt in a first direction along said longitudinal axis.

17. The foldable firearm according to claim 16, wherein said charging slide moves said bolt in a second direction along said longitudinal axis when said charging slide moves in said second direction along said rail.

18. The foldable firearm according to claim 17, wherein said bolt compresses said action spring when moving in said second direction.

19. The foldable firearm according to claim 15, further comprising a second grip extending away from a second side opposing said first side of said body along said second axis.

20. The foldable firearm according to claim 15, wherein said barrel is pivotably coupled to said receiver assembly via a hinge.

* * * * *